United States Patent [19]

Nürk

[11] Patent Number: 4,918,948

[45] Date of Patent: Apr. 24, 1990

[54] THREAD FEEDER FOR KNITTING MACHINES

[75] Inventor: Siegfried Nürk, Albstadt, Fed. Rep. of Germany

[73] Assignee: SIPRA Patententwicklungs- u.Beteiligungsgesellschaft mbH, Albstadt, Fed. Rep. of Germany

[21] Appl. No.: 177,780

[22] Filed: Apr. 5, 1988

[30] Foreign Application Priority Data

Apr. 6, 1987 [DE] Fed. Rep. of Germany ..... 3711558

[51] Int. Cl.[5] ..... D04B 15/48

[52] U.S. Cl. ..... 66/132 T; 242/47.01

[58] Field of Search ..... 66/125 R, 132 R, 132 T; 242/47.01

[56] References Cited

U.S. PATENT DOCUMENTS

| | | | |
|---|---|---|---|
| 3,955,769 | 5/1976 | Kajiura et al. | 242/47.01 |
| 4,003,223 | 1/1977 | Vossen | 66/125 R |
| 4,161,297 | 7/1979 | Vella | 242/47.01 |
| 4,227,657 | 10/1980 | Simin et al. | 242/47.01 |
| 4,318,285 | 3/1982 | Jacobsson et al. | 66/132 T |
| 4,660,783 | 4/1987 | Roser et al. | 242/47.01 X |
| 4,669,677 | 6/1987 | Roser et al. | 242/47.01 |

FOREIGN PATENT DOCUMENTS

| | | | |
|---|---|---|---|
| 536105 | 2/1977 | U.S.S.R. | 66/132 T |
| 2156867 | 10/1985 | United Kingdom | 66/132 R |

*Primary Examiner*—Wm. Carter Reynolds

[57] ABSTRACT

A thread feeding device for knitting machines having a rotor on which a thread feeding element is mounted which is divided into a thread lead-in ring section, a thread reserve section and a lead-out section. To enable the thread feeding device to be operated selectively with a plain continuous reserve section or one formed by rods, a rod cage consisting of a premanufactured component is provided, which can be fastened coaxially on the rotor. The cage has a lead-in ring bearing the lead-in ring section, and a plurality of rods forming the reserve section, each rod being fastened at one end to the lead-in ring. The other ends of the rods are either fastened to a mounting which can be joined to the rotor and is part of the component, or they are held directly on the rotor and thus radially centered about the axis of rotation.

17 Claims, 6 Drawing Sheets

Figure 1:
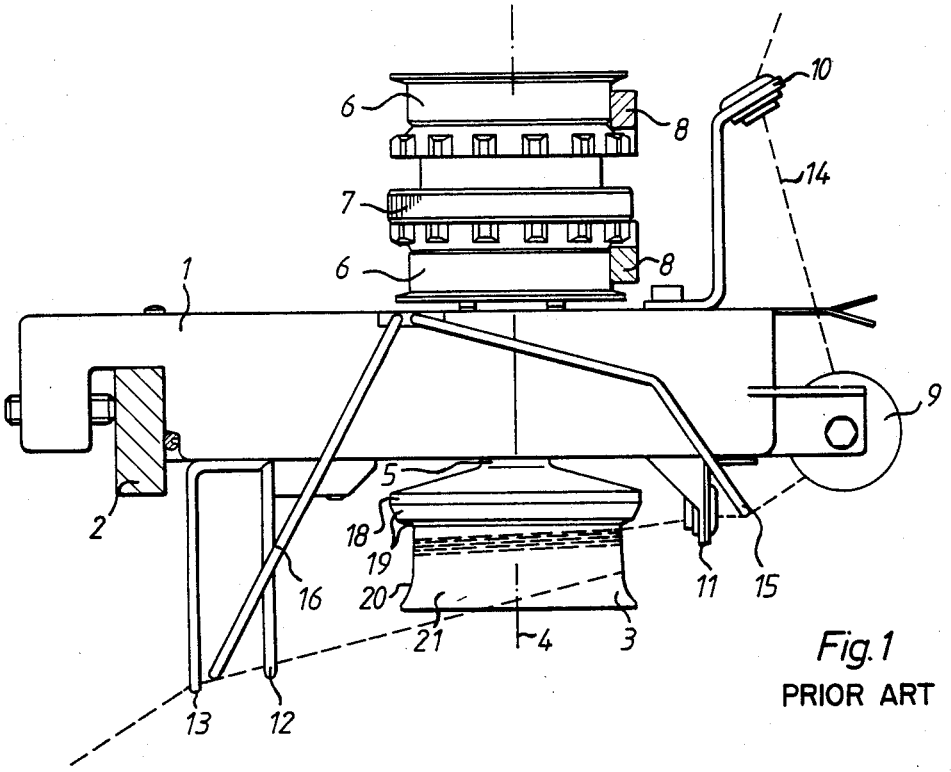
Fig. 1 PRIOR ART

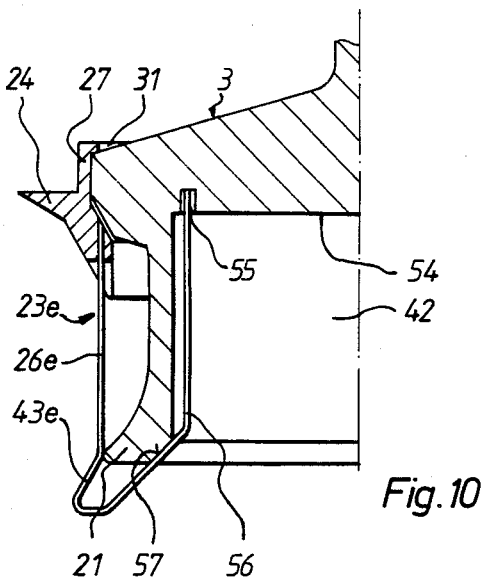
Fig. 10
Fig. 11
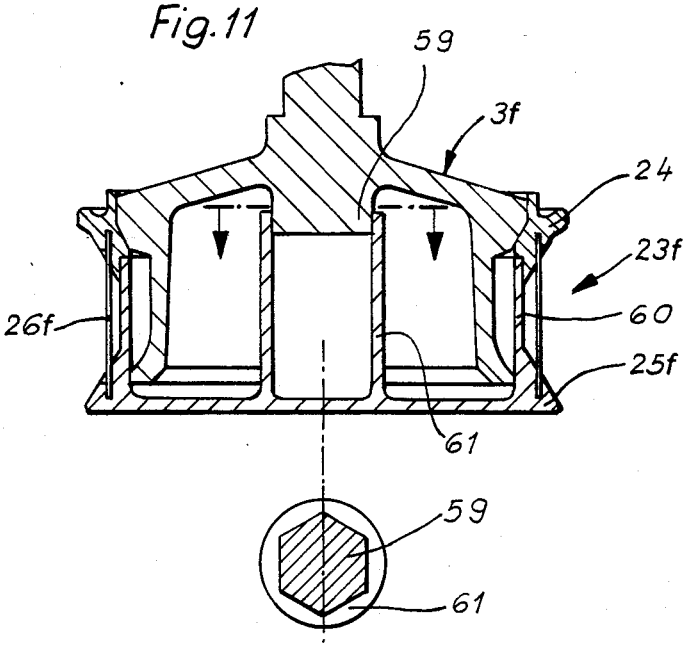

THREAD FEEDER FOR KNITTING MACHINES

BACKGROUND OF THE INVENTION The invention relates to a thread feeding device for knitting machines having a carrier means and a rotor which is mounted thereon for rotation about an axis and on which is fastened a thread feeding element with a lead-in section tapering inwardly, a thread storage section adjoining the latter, and a following end section, and also having a thread entry guide means for bringing the thread to the lead-in section, and a thread exit guide means for bringing the thread out of the thread storage section.

In known thread feeders of this kind (DE Patents No. 35 01 944 and 35 16 891 and U.S. Pat. No. 4,180,215) the feed drums have an entirely plain, continuous supporting surface and therefore entirely plain, continuous thread lead-in, storage or reserve and lead-out sections. Such thread feeders are used in continuously driven feed drums either for the positive and nonslip delivery of thread or for the non-positive friction feeding which is performed with slippage, and they operate satisfactorily with a great number of types of thread. In the use of other types of yarns, e.g. nontextured yarns such as polyester threads, however, filaments are frequently pulled out of the thread sections leaving the feed drum or even out of some of the coils of thread that are in the storage section. Aside from that, the high surface cling sometimes results in difficulties, at least in the case of some of the desired functions.

Attempts to carry the thread coils on the drum surface with reduced tension, or to provide that surface in a known manner (DE Pat. No. 33 26 099) with grooves, slots or ribs have led to no useful results.

On the other hand, to avoid this disadvantage, it has proven surprisingly to be especially advantageous to use thread feeders of another known kind (DE-OS 32 26 373, and DE Patent No. 35 06 490 and U.S. Pat. No. 4,669,677 ) which have rods in the storage section on which the threads are supported. Such thread-feeders have heretofore served mainly for applications in which the feed drums are driven intermittently in start-stop operation, since the thread supporting rods result in a reduction of the mass of the feed drums, and this is desirable for a rapid response when they are accelerated or stopped. Such thread feeders are not universally usable because the threads often call for friction conditions which can be assured only by feed drums having plain, continuous circumferential surfaces.

Therefore, in practice, there is a desire for thread feeding devices having feeder drums which can be provided with either plain, continuous surfaces or with rod-like support elements according to the thread material Such feeding devices have heretofore been unknown in connection with knitting machines. It would be conceivable to provide devices made in the form of spools which can be removably set on the feed cylinders and have plain, continuous surfaces of different coefficients of friction and/or diameters, in order thereby to provide for the different properties of the threads (U.S. Pat. No. 3,528,622). A similar application of this principle to feeding devices whose feed drums are provided selectively with plain, continuous circumferential surfaces or surfaces formed by rodlike supporting elements, it is not easily possible, for geometrical reasons.

It is an object of this invention to design the thread feeding apparatus of the kind described above such that, with little constructional difficulty, and expense, it will be able to operate either with the conventional plain, continuous storage section or with one formed of rod-like supporting elements, or optionally with reserve sections which are formed of rod-like supporting elements with different properties and/or systems selected according to the thread material. A further object is to design the thread feeding apparatus such that the changeover from one type of drum to the other is possible with little manipulation and with constructionally simple means.

For the solution of this object and according to this invention the thread feeding device is characterized in that the thread feeding element is a rod cage (23) consisting of a premanufactured component which has a lead-in element which contains the lead-in section and can be fastened for easy removal on the rotor (3,5), and which can be radially centered on the latter, and has a plurality of rod-like supporting elements (26) with support surfaces, said elements forming the storage section and being disposed substantially parallel to the axis of rotation such that the support surfaces are distributed on a cylindrical surface coaxial with the axis of rotation (4) or on a conical surface slightly tapered toward the end section (21), and said elements (26) having first ends fixedly joined to the lead-in element (24) and second ends which either are fastened to a mounting (25,41,47, 51) which can be joined to the rotor (3,5) and belong to the component, or are held directly on the rotor (3,5) and thereby radially centered with respect to the axis of rotation.

The invention offers important advantages in addition to the possible use of prefabricated cages. The removal of a cage for the purpose of cleaning, repair or replacement can be performed simply by pulling away its lead in element and, in some cases, the mounting. Likewise simple is the placement of a cage on the rotor. If simple clip-on or snap-on mechanisms are used, then not even a tool is necessary for the purpose. Only a few and very easily manufactured components are needed for the production of the cage. The down time of the knitting machine in the case of cleaning, repair or replacement operations, is limited virtually to the short amount of time needed for installation and removal. Retrofitting already existing thread feeders having conventional feed drums with the cages according to the invention is easily possible by providing the latter with appropriate lead-ins and mountings. If the lead-in is placed, for example, on an end section of the feed drum, the section of its surface that is important for the lead-in of the thread can be disposed in the axial direction substantially at the point where the thread enters the feeder even if a cage is not in place so that, when the cage is used, no readjustment of the thread lead-in or thread lead-out guiding means is necessary. Furthermore, the cages, like the feed drums already present, can be used to feed threads with or without slippage, in which case the fiber tearing or fiber separation that occur in the use of the former feed drums in connection with polyester threads or the like are no longer observed. Lastly, it is advantageous that the thread entry can take place along a substantially continuous surface, while the thread is guided within the storage area only on the rod like supporting elements.

Additional advantageous features of the invention will be seen in the subordinate claims.

Figure 2:
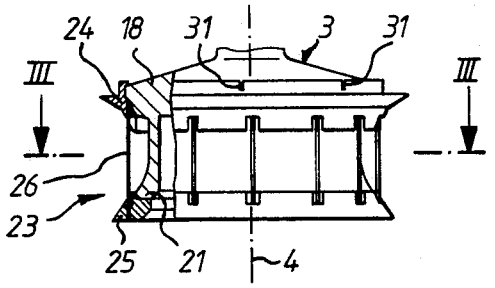
Figure 3:
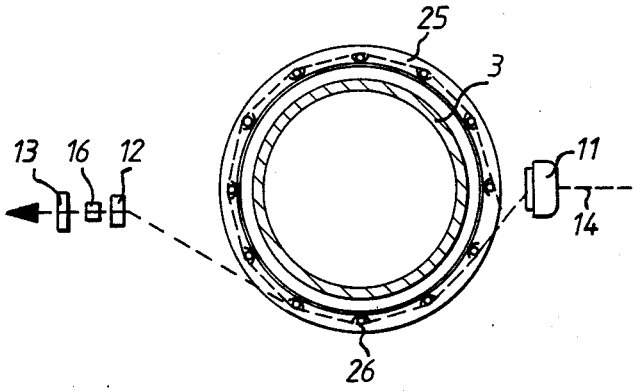
Figure 4:
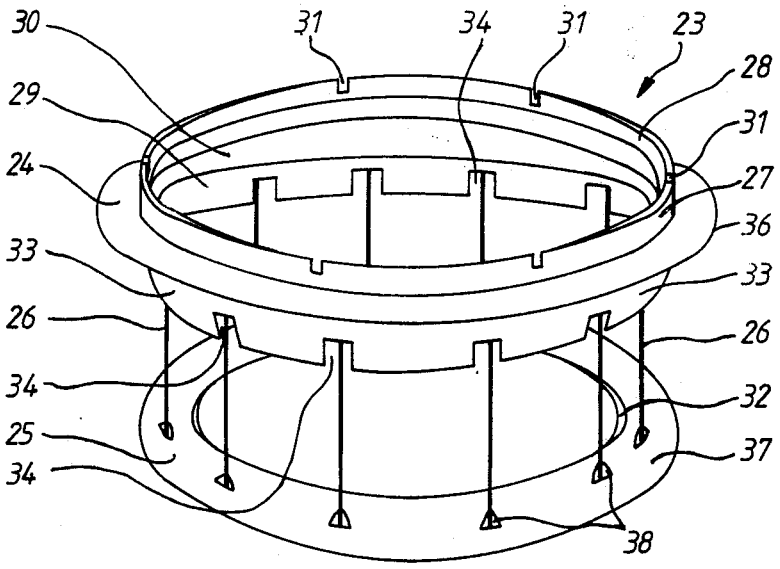
Figure 5:
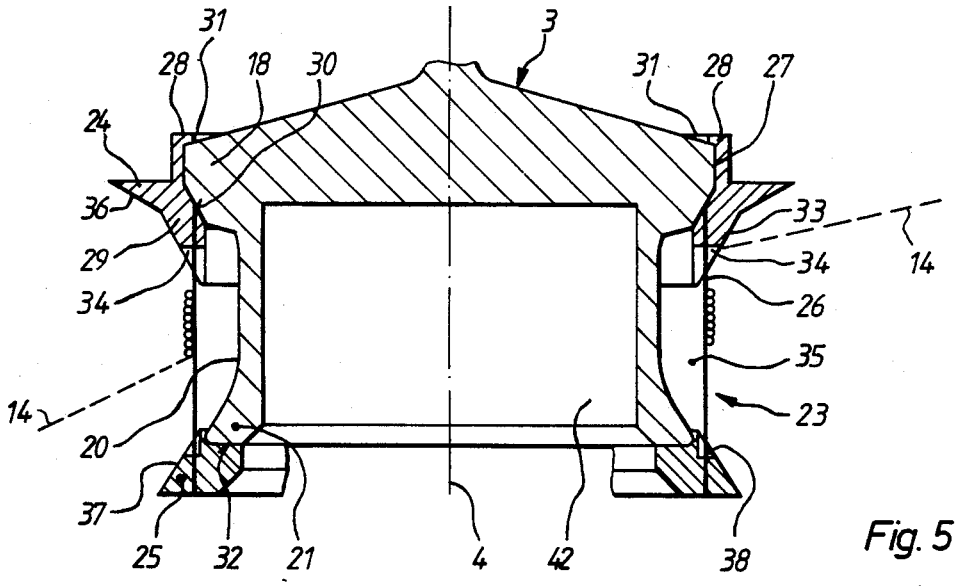

The invention will be further explained below in conjunction with embodiments shown in the appended drawing, wherein:

FIG. 1 is a general side view of a known thread feeding system,

FIG. 2 is a partially cutaway side view of the feed drum of the thread feeding device according to FIG. 1 with the cage according to the invention installed, FIG. 3 is a section taken along line III—III of FIG. 2, wherein the position of the thread guiding elements and the course of the thread are indicated diagrammatically and in broken lines, FIG. 4 is a perspective representation of the cage on a larger scale than in FIGS. 2 and 3, FIG. 5 is an enlarged longitudinal section through the feed drum with the cage installed, and FIGS. 6 to 11 respectively show sections corresponding to FIG. 5, through five alternative embodiments of the combination according to the invention of feed drum and cage, only the left half being represented in each case.

The thread feeding device represented in FIG. 1 a carrier beam 1 which is releasably fastened at its one end to a mounting rail 2 of a knitting machine On the bottom of the beam 1 there is a rotor 3 in the form of a conventional feed drum, which is rotatable about an axis 4 and for this purpose is fixedly joined to a shaft 5 journaled in the beam 1. On a portion of the shaft 5 projecting above the top side of the beam 1 two belt pulleys 6 are journaled, which can be selectively coupled to a clutch means 7. The clutch means 7 consists for example of a clutch disk mounted between the two belt pulleys 6 so as to be axially displaceable but corotational with the shaft 5. The belt pulleys are driven at different speeds by a drive not shown, by means of belts 8.

A thread brake 9 and a thread eyelet 10 are fastened on the end of the beam 1. A thread entry guide 11, an eyelet for example, is disposed between the thread brake 9 and the feed drum 3, while on the side of the feed drum 3 diametrically opposite the entry guide 11 two additional thread exit guides 12 and 13 fastened to the bottom of the beam 1 are provided, which can also consist of open or closed eyelets. A thread 14 is carried from a spool, not shown, through the thread eyelet 10, the thread brake 9 and the thread entry guide 11, downwardly at an angle and substantially tangentially onto the thread bearing surface of the feed drum. At least one turn, preferably several turns, are wound onto it, and finally it is passed through the two guides 12 and 13 to the knitting station, not shown, of a knitting machine. Sensors 15 and 16, which are likewise mounted on the beam 1, can serve in the conventional manner as detectors of the thread 14.

The feed drum 3 has, as seen in FIG. 1, a first end section 18 at the top, an adjoining entry section 19 tapering inwardly and toward the axis of rotation 4, and then a storage or reserve section 20 which merges with a second end section 21 at the bottom, which often is flared outwardly. Thread feeding devices of the construction seen in FIG. 1 are basically known (U.S. Pat. No. 4,180,215). The various sections of the feed drum can be configured as desired, although certain forms intended especially for the entry section and the second end section 21 have proven to be especially advantageous (DE Pats. No. 35 01 944 and 35 16 891).

As seen in FIGS. 2 and 3, according to the invention a cage 23 is placed coaxially over the rotor 3 consisting of the feed drum, and has an annular lead in 24 and an annular holder 25, the entry element coming to rest coaxially on the first end section 18 and the holder on the second end section 21 of the feed drum. Between the lead-in ring 24 and the holder 25 there are disposed a number of rods 26 consisting, for example, of steel wire or spring wire, forming a thread reserve area on the cage 23; they are substantially parallel to the axis of rotation 4, and distributed along the circumference of an imaginary cylinder or cone coaxial with the axis of rotation (FIG. 3) and tapering slightly toward the end section 21. The rods 26 are preferably at the same angular distance apart, although at least slightly different angular spacing is conceivable. The fastening of the rods 26 on the lead-in ring 24 and holder 25 is accomplished, for example, by creating holes or bores in their confronting annular surfaces, and press-fitting the upper (first) and lower (second) ends of the rods 26 into those holes or bores and, if necessary, additionally cementing them in place.

As seen in FIGS. 4 and 5, the lead-in ring 24 has a somewhat channel-like circumferential mounting section 27 which is provided with a substantially cylindrical inside surface, and whose diameter corresponds to the outside diameter of the first end section 18 of the rotor 3 At the top in FIG. 4, a lip 28 of the mounting section 27 lies on the top of the first end section 18, while a skirt 29 at the bottom in FIG. 5 can additionally be in contact with a tapering portion 30 at the bottom of the first end section 18. The mounting section 27 thus is mated with the outer circumference of the end section 18 and the lead-in ring 24, together with the first ends of the rods 26 which it holds, and it is held fast radially and axially on the rotor 3 and also radially centered on the axis of rotation 4 by the first end section 18.

To make possible a simple attachment and release of the mounting section 27, the latter has in its lip 28 a number of radial slots or notches 31 (FIGS. 2, 4 and 5), so that a number of segments are formed which are spread radially outwardly by the first end section 18 when the mounting section 27 is installed or removed, and then snaps back radially inwardly. Thus the mounting section 27 is attached by a kind of snap-fastening to the rotor 3, so that no tool is needed for putting it on or taking it off. Preferably the entire lead-in ring 24 consists of a sufficiently flexible or thin material, so that the mounting section 27 can be fastened securely without a tool to the first end section 18 on the basis of its resilient properties.

The annular holder 25 consists, as seen in FIGS. 4 and 5, of a ring which has in its upper surface, as seen in FIG. 5, a right-angled circumferential edge 32 for the bottom part of the second end section 21. The arrangement is preferably such that the end section 21 is held by a press fit between the walls of the shoulder 32 and thus the holder 25 is fixed axially and radially on the end section 21. Thus also the two ends of the rods 26 are centered radially on the axis of rotation 4. No tool of any kind is needed for the removal of the annular holder.

In FIGS. 4 and 5 the rods 26 are entirely rectilinear. In order nevertheless to create the surfaces in the area of the thread entry and exit to support the thread 14 as required for trouble-free operation, when the cage 23 is used, the lead-in ring 24 has on its outer side, and outside of the imaginary cylinder or cone formed by the rods 26, a circumferential, plain, continuous lead in ring surface 33 tapering downwardly and inwardly as seen in FIGS. 4 and 5, i.e., narrowing toward the axis 4, for the thread 14, which surface is best configured like the corresponding surfaces of the preferred known feed drums (DE Pat. No. 35 01 944), although other forms may be desirable in conjunction with the rods. In particular, the lead-in ring surface 33 can have the same taper angle all the way. In that case the lead-in ring surface 33 is prolonged inwardly to just beyond the inside diameter of the imaginary cylinder or taper formed by the rods supporting elements 26, in which case notches or recesses 34 are incorporated into the lead-in ring 24 at the transition between the lead-in ring surface 33 and the rods 26, which reduce but slightly the broad-surface support of the thread 14. The notches 34 create an opening in the area of the transitions to the reserve section, surrounding each rod 26, and through it any dirt, lint or the like can pass radially rearward, i.e., into a clearance 35 between the rods 26 and the circumference of the rotor 3. Furthermore, the notches 34 permit a smooth passage of the thread 14 from the lead-in ring surface onto the supporting elements 26 without any perceptible hopping The plain, continuous lead-in ring surface 33 offers the advantage that in the lead-in ring area the thread 14 will be guided on a surface, not guided by point contacts as it will afterward in the reserve element, and thus will be prevented from prematurely slipping onto the reserve element. Otherwise the lead-in ring surface 33 can be prolonged outwardly and upwardly, as seen in FIG. 5, by a flange 36 which serves as a shield and prevents any undesirable slipping of loose layers of thread onto the upper side of the cage or onto the rotor 3.

The mounting 25, as seen in FIGS. 4 and 5, provided on its side situated outside of the imaginary cylinder or cone of the rods 26, with a run-out surface 37 running outwardly and downwardly and conically flaring. Although this run-out surface 37 could fundamentally be built in the manner of the preferred feed drums (DE Pat. No. 35 16 891), it is basically sufficient, in the case of thread feeds using rods, if the run-out surface 37 has a constant taper angle throughout, so as to avoid the build-up of fiber loops and the dropping of loose thread coils from the reserve element. At the transitions between the thread-bearing elements 26 and the run-out surface 37, notches 38 are again provided, which permit a continuous, smooth passage of the thread onto the run-out surface 37 and the inward and downward escape of impurities, lint or the like, and they can be like the notches 34. Otherwise, the notches 34 and 38 have advantages in production Since the burs which are unavoidable in producing the bores for the rods 26 do not come in contact with the thread, there is no need for finishing operations. Also, the drills used in drilling them will not "walk."

The cage 23 consists of a unit supplied by the manufacturer, and its lead-in ring 24 and its holding ring 25 in accordance with the above description are placed when needed onto the feed drum, which can also operate without the cage 23, and are fastened thereon. Since in the case of the embodiment according to FIGS. 1 to 4 the feed drum is fastened at its upper end to the drive shaft 5, the cage 23 in this case is pulled up onto the feed drum from below. This is easily possible because the first end section 18 has a greater diameter than the second end section 21, and the lip 28 of the mounting section 27 is able if necessary to stretch slightly when passed over the bottom end section 21. Aside rom that, it is possible to produce the lead-in ring 24 and the mounting 25 from flexible plastics, e.g., by injection molding, so that the entire cage 23 is in itself elastic and therefore can stretch sufficiently when placed onto the feed drum. The rods 26 consist preferably of a wear resistant material or one made wear resistant by coating. The same applies at least to the lead-in ring surface 33.

Numerous modifications of the embodiment described in connection with FIGS. 1 to 5 are possible, some of which are represented in FIGS. 6 to 10, using the same reference numbers but with distinguishing letters, for equal parts.

Figure 6:
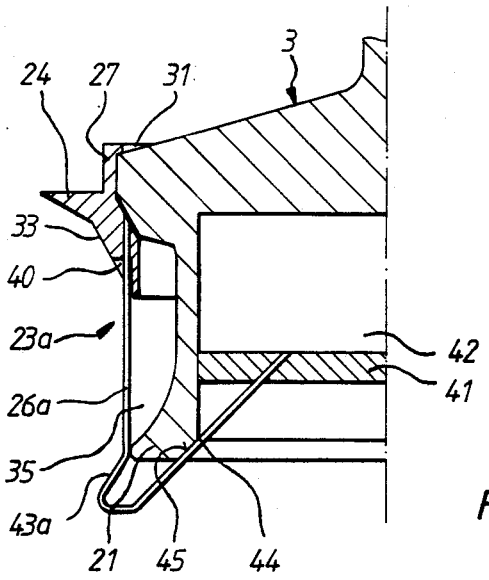

In the embodiment according to FIG. 6, instead of the notches 34, only the recesses 40 formed in the manner of blind holes surrounding the rods 26 are provided, which do not create any passage to the interior clearance 35, but nevertheless permit a smooth transition from the lead-in ring surface 33 to the rods 26*a*. Furthermore, a mounting 41 in the form of a circular disk is provided, which is suitable for pot-shaped rotors with an inner cavity 42 and is preferably pressed into the latter with a sliding fit, but can also be made so as to snap into place. The bottom, second ends of the rods 26*a* of rectilinear shape are supported at the outer end of the second end section 21 of the rotor 3 and provided with prolongations which have first an outwardly bent section 43*a* corresponding to the run-out surface 37 according to FIG. 4, then a section bent back at about 180°, and finally a mounting section 44 which is fastened in the mounting 41 and is preferably additionally supported on the inside surface of the bottom margin of the feed drum at 45, as seen in FIG. 6. The run-out sections 43*a* together prevent the drop-out of loose coils of thread and the build-up of fiber rings, while the mounting sections 44 additionally center the rods 26 radially.

Figure 7:
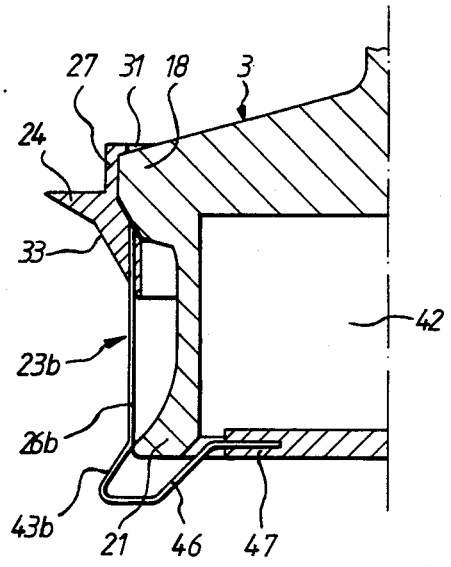

The embodiment according to FIG. 7 differs from the embodiment shown in FIGS. 1 to 5 in that the notches 34 are lacking, while in comparison to FIG. 6 mounting sections 46 are provided which are not additionally supported on the rotor 3 but are only held in a mounting 47 in the form of a circular disk which is inserted into the cavity 42, and is neither centered nor fixed in the cavity 42.

Figure 8:
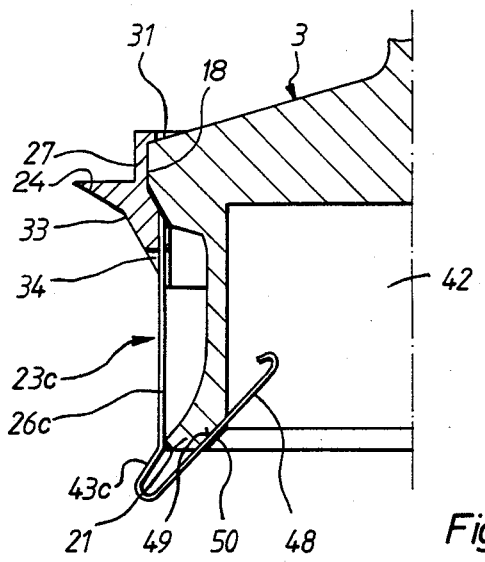

In the embodiment according to FIG. 8, the mounting 25, 41 and 47 is lacking. Instead the rods 26*c*, configured similarly to FIG. 6, are provided with mounting sections 48 which are supported on the inner margin of the rotor 3 at 49 and snap into radial notches 50 which are formed on the inside of the bottom edge, of the rotor 3 as seen in FIG. 8. The mounting of the cage 23*c* is performed by first placing the lead-in ring 24 onto the first end section 18 of the feed drum and then slipping the second ends of the resilient rods 26*c* into the notches 50.

Figure 9:
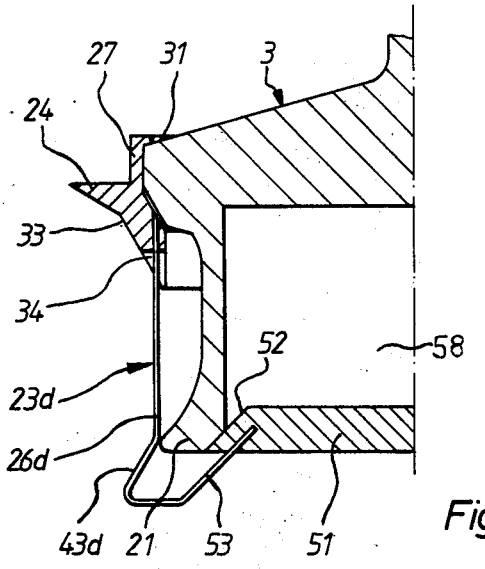

The embodiment according to FIG. 9 differs from the one in FIG. 7 substantially in the shape of a mounting 51 which is a circular disk with a conically beveled outer margin 52 which engages a likewise beveled inside bottom margin of the rotor 3 or is held by snap-fastening, and accommodates mounting sections 53 which are formed on the prolongations of the rods 26*d*. Also, in contrast to FIG. 7, the notches 34 are provided. The mounting disks 25, 41, 47 and 51 can in any case be replaced by rings or ring segments.

FIG. 10 shows an embodiment in which, as in FIG. 8, the mounting 25, 41, 47 and 51 is lacking. Instead the rotor 3 has a wall 54 defining the top of a cavity 58 and having a circumferential groove 55, or short radial slots, or even bores, into which extend the free ends of mounting sections 56 of the rods 26*e*. These mounting sections 56 are furthermore bent so that they can rest at middle portions like those seen in FIGS. 6 and 8 against the insides of the bottom margins of rotor 3, as shown at 57.

FIG. 11 shows an embodiment in which the rotor 3*f* is additionally provided with a coaxial projection 59 extending into its inner cavity and configured in the manner of a polygon, e.g., a hexagon. The mounting 25 of the cage 23 which can be placed on the rotor 3*f* is connected by a plain, continuous circumferential wall 60 surrounding the rotor 3*f* to the lead-in ring 24*f*, e.g., by cementing or ultrasonic welding. Furthermore, the mounting 25*f* has a tubular projection 61 extending into the cavity of the rotor 3*f*, and this projection has an inside cross section corresponding to the outside cross section of the projection 59 and, when the cage 23*f* is placed on the rotor, it is pushed onto the projection 59 and coupled for corotation with the latter. Thus a mechanically very stable cage 23*f* consisting of one piece is obtained, which upon the rotation of the rotor 3*f* will reliably be driven by the latter The rest of the arrangement is substantially in accordance with FIGS. 1 to 5.

The invention is not limited to the embodiments described, which can be modified in many ways. In particular, the cages can be provided with rods varying in number, diameter, length, material and shape, according to requirements. Also the diameter of the imaginary cylinder or cone can be selected as desired. This diameter should, however, on the one hand be so great that the thread 14 comes to lie not only on the rods 26 to 26*f*, but not be in contact with the periphery of the rotor 3, 3*f* between them, and on the other hand it should be sufficiently small for the maximum diameter of the entire cage 23 to 23*f* to remain small and so that no change in the position of the guides 11, 12 and 13 becomes necessary. For the same reason the lead-in ring surface 33 (FIG. 4) for the threads 14 is preferably disposed at such a point on the lead-in ring 24 that the position and alignment of the guides 11, 12 and 13 can remain unchanged independently thereof, whether the feed drum is used alone or with the cage 23 to 23*f* installed on it.

Figure 12:
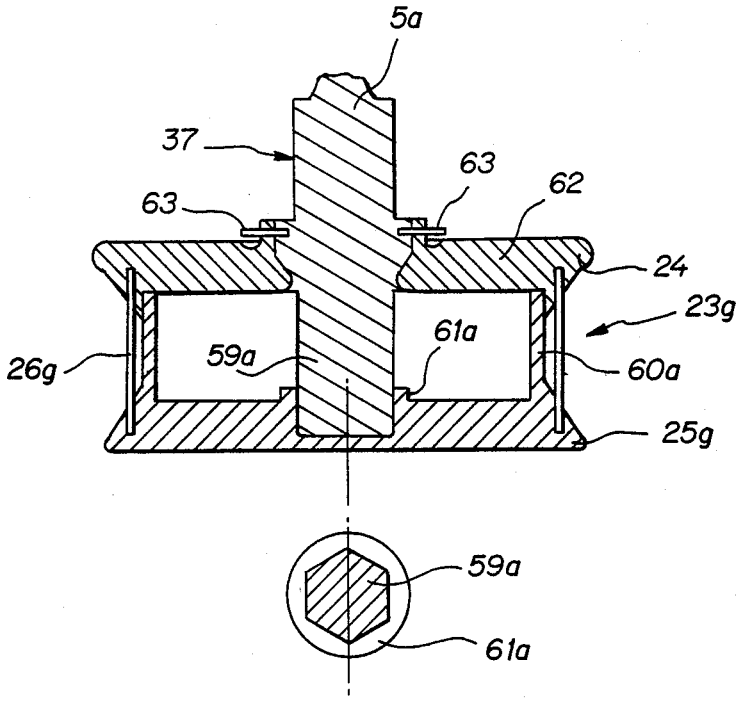

The invention also is not limited to the rotor's being an independently functional thread feed drum. Such an embodiment is preferred at least for those cases in which a thread feed device having a drum with a plain, continuous surface is already in operation and is to be supplemented by the above-described cage 23 to 23*f*. In other cases (see FIG. 12) it would be conceivable to provide as the rotor 3*f* only the shaft 5*a*, to make the lead-in ring section 24 of the cage 23*g* substantially a disk 62, and to fasten the cage 23*g* on the shaft 5*a* by means of this disk 62 so as to be easily replaceable. At the same time the shaft 5*a* and the disk could be provided with corresponding fastening means cooperating in the manner of a snap fastening (pin 63) or with plug-in or clamping fastener which permit easy separation and release, and preferably directly assure the necessary axial alignment and radial centering. Alternatively, the rotor might consist of any object serving only for the mounting of the cage 23*g* and fastened in turn to the shaft 5, which would have the advantage that, unlike the case in FIGS. 1 to 11, it could be manufactured very cheaply since it would not have to have any surfaces suitable for thread guidance which could be made only by precision methods.

In such a case the cage 23*g* could, if necessary, be associated with feed drums which, like the cages, could be fastened to the rotor by plugging in, snapping on or clamping and could have properties adapted to selected types of threads or applications, especially thread supporting surfaces. Thus it would be possible for the knitter to adapt his knitting machine to the conditions involved in the individual case with very little trouble, i e., without difficult manipulations or adjustments and without replacing the entire thread feed apparatus.

The configuration of the cage 23 to 23*f* according to the invention permits extremely simple and inexpensive series manufacture. For this purpose the lead-in ring rings 24 and mountings 25 are made, for example, from injection molded parts, the rods 26 to 26*f* being laid in the die and therefore molded in place.

According to an especially preferred embodiment, the diameter of the cage 23 to 23*f* in the area of the thread reserve amounts to 53 mm when eight to eighteen, preferably twelve, rods 26 to 26*f* are used. These rods 26 to 26*f* are disposed with a slight slope toward the axis of rotation, so that in the area of the thread exit a diameter that is about 0.80 mm, preferably 0.60 mm, less than in the area of the thread entry, when these two areas are, for example, 16.5 mm apart. This spacing can also be greater or smaller, and is preferably such that the position of the guides 11, 12 and 13 can remain unaltered. The diameter of the rods 26 to 26*f* amounts, for example, to 0.30 to 1.5 mm, preferably 0.45 mm. The rods 26 to 26*f* consist of a preferably stainless steel wire (spring steel wire). The entry surface 33 has a taper angle of about 30° with respect to the axis 4. The lead-in rings 24 and mountings 25 consist preferably of a wear-resistant material, or at least one made wear-resistant by coating, especially of plastic.

I claim:

1. Thread feeding device for feeding a thread to a knitting machine, comprising: a carrier means; a rotor mounted on said carrier means for rotation about an axis and having a first and second end section; means coupled to said rotor for rotating the latter about said axis; a thread feeding and storage means fastened to said rotor; a thread entry guide means for guiding the thread when being fed to said feeding and storage means; and a thread guide means for guiding the thread when running out of said feeding and storage means; said feeding and storage means being a premanufactured rod cage at least having a thread lead-in section and a thread storage section for storing at least one turn of said thread, said storage section comprising a plurality of rod-like, rectilinear supporting elements having support surfaces, said supporting elements having first and second ends and being disposed substantially parallel to said axis such that said support surfaces are distributed on a substantially cylindrical surface coaxial with said axis, said lead-in section being a ring, said ring comprising a plurality of holes in each of which one of said first ends of said supporting elements is fixedly secured, and a substantially continuous, conically and inwardly tapering circumferential lead-in surface outside of said substantially cylindrical surface and coaxially disposed with respect to said axis and extending at least up to the supporting elements for leading the thread coming from said entry guide means onto said storage section; and first and second means for easily mounting and dismounting said feeding and storage means as a whole to and from said rotor for cleaning, repairing and replacing the same, said first means easily and removably attaching and centering said ring on said first rotor end section, and said second means at least easily centering said second ends of said supporting elements on said second rotor end section.

2. Thread feeding device according to claim 1, wherein said first means consists of an annular component placeable on said first end section.

3. Thread feeding device according to claim 1, wherein the lead-in surface extends inwardly beyond the supporting elements and has in the area of the transitions to the supporting elements recesses surrounding each one of the latter.

4. Thread feeding device according to claim 1, wherein said second means comprises a mounting being a part of said rod cage and comprising an annular component which is placeable on the second rotor end section and which has a plurality of holes in each of which one of said second ends of said supporting elements is fixedly secured.

5. Thread feeding device according to claim 4, wherein said mounting has, on a side lying outside said support surface, a lead-out surface at least extending up to the supporting elements and widened conically outwardly.

6. Thread feeding device according to claim 4 or 5, wherein said second means also easily and removably attaches said second ends of said supporting elements to said second rotor end section, and wherein said mounting has an right-angled circumferential edge such that said second end section is held by a press fit between walls defining said shoulder.

7. Thread feeding device according to claim 4 or 5, wherein said mounting is connected to said lead-in section by a wall surrounding said rotor.

8. Thread feeding device according to claim 1, wherein said rotor has an internal cavity, wherein said second means has a mounting being a part of said rod cage and being removably accommodated in said cavity, and wherein said second ends of said support elements have prolongations extending into the mounting.

9. Thread feeding device according to claim 8, wherein said prolongations have each an outwardly bent lead-out section, and wherein all lead-out sections lie on a cone surface coaxial with said axis.

10. Thread feeding device according to claim 8, wherein the prolongations have each an inwardly bent section and a mounting section for at least centering said supporting elements on a lower margin of said rotor.

11. Thread feeding device according to claim 8, 9, or 10, wherein said second ends of said supporting elements are supported at an outer end of said second rotor end section.

12. Thread feeding device according to claim 1, wherein said support surfaces are distributed conically and taper outwardly toward said second end section.

13. Thread feeding device for feeding a thread to a knitting machine, comprising: a carrier means; a rotor mounted on said carrier means for rotation about an axis and having a first and second end section; means coupled to said rotor for rotating the latter about said axis; a thread feeding and storage means fastened to said rotor; a thread entry guide means for guiding the thread when being fed to said feeding and storage means; and a thread guide means for guiding the thread when running out of said feeding and storage means; said feeding and storage means being a premanufactured rod cage at least having a thread storage section and a thread lead-in section, said storage section comprising a plurality of rod-like, rectilinear supporting elements having support surfaces, said supporting elements having first and second ends and being disposed substantially parallel to said axis such that said support surfaces are distributed on a substantially cylindrical surface coaxial with said axis, said lead-in section being a ring, said ring comprising a plurality of holes in each of which one of said first ends of said supporting elements is fixedly secured, and a substantially continuous, conically and inwardly tapering circumferential lead-in surface outside of said substantially cylindrical surface and coaxially disposed with respect to said axis and extending at least up to the supporting elements for leading the thread onto said storage section; and first and second means for easily mounting and dismounting said feeding and storage means as a whole to and from said rotor for cleaning, repairing and replacing the same, said first means easily and removably attaching and centering said ring on said first rotor end section, and said second means at least easily centering said second ends of said supporting elements on said second rotor end section, said rotor consisting of a thread feeding element which is constructed as a feeding drum and has at least said first end section, a further inwardly tapered lead-in ring section, a further storage section, and said second end section.

14. Thread feeding device for feeding a thread to a knitting machine, comprising: a carrier means; a rotor mounted on said carrier means for rotation about an axis and having a first and second end section; means coupled to said rotor for rotating the latter about said axis; a thread feeding and storage means fastened to said rotor; a thread entry guide means for guiding the thread when being fed to said feeding and storage means; and a thread guide means for guiding the thread when running out of said feeding and storage means; said feeding and storage means being a premanufactured rod cage at least having a thread storage section and a thread lead-in section, said storage section comprising a plurality of rod-like, rectilinear supporting elements having support surfaces, said supporting elements having first and second ends and being disposed substantially parallel to said axis such that said support surfaces are distributed on a substantially cylindrical surface coaxial with said axis, said lead-in section being a ring, said ring comprising a plurality of holes in each of which one of said first ends of said supporting elements is fixedly secured, and a substantially continuous, conically and inwardly tapering circumferential lead-in surface outside of said substantially cylindrical surface and coaxially disposed with respect to said axis and extending at least up to the supporting elements for leading the thread onto said storage section; and first and second means for easily mounting and dismounting said feeding and storage means as a whole to and from said rotor for cleaning, repairing and replacing the same, said first means easily and removably attaching and centering said ring on said first rotor end section, and said second means at least easily centering said second ends of said supporting elements on said second rotor end section, said first means consisting of an annular component placeable on said first end section, and having a resiliently yielding holding section clasping the first rotor end section by a snap-fastening like action.

15. Thread feeding device for feeding a thread to a knitting machine, comprising: a carrier means; a rotor mounted on said carrier means for rotating about an axis and having a first and second end section; means coupled to said rotor for rotating the latter about said axis; a thread feeding and storage means fastened to said rotor; a thread entry guide means for guiding the thread when being fed to said feeding and storage means; and a thread guide means for guiding the thread when running out of said feeding and storage means; said feeding and storage means being a premanufactured rod cage at least having a thread storage section and a thread lead-in section, said storage section comprising a plurality of rod-like, rectilinear supporting elements having support surfaces, said supporting elements having first and second ends and being disposed substantially parallel to said axis such that said support surfaces are distributed on a substantially cylindrical surface coaxial with said axis, said lead-in section being a ring, said ring comprising a plurality of holes in each of which one of said first ends of said supporting elements is fixedly secured, and a substantially continuous, conically and inwardly tapering circumferential lead-in surface outside of said substantially cylindrical surface and coaxially disposed with respect to said axis and extending at least up to the supporting elements for leading the thread onto said storage section; and first and second means for easily mounting and dismounting said feeding and storage means as a whole to and from said rotor for cleaning, repairing and replacing the same, said first means easily and removably attaching and centering said ring on said first rotor end section, and said second means at least easily centering said second ends of said supporting elements on said second rotor end section, said second means comprising a mounting being a part of said rod cage and comprising an annular component which is placeable on the second rotor end section and which has a plurality of holes in each of which one of said second ends of said supporting elements is fixedly secured, said rotor having a cavity and a first projection coaxially aligned with said axis and extending into said cavity, said mounting having a second projection extending into said cavity and being coaxially aligned with said axis, one of said projections being a tubular projection and having an inside polygonal cross-section and the other projection having an outside polygonal cross-section corresponding to the polygonal inside cross-section, said one projection being placed in said other projection for co-rotation therewith, when the rod cage is placed on the rotor.

16. Thread feeding device according to claim 15, wherein said lead-in section and the mounting are joined fixedly together into one component.

17. Thread feeding device for feeding a thread to a knitting machine, comprising; a carrier means; a rotor mounted on said carrier means for rotation about an axis and having a first and second end section; means coupled to said rotor for rotating the latter about said axis; a thread feeding and storage means fastened to said rotor; a thread entry guide means for guiding the thread when being fed to said feeding and storage means; and a thread guide means for guiding the thread when running out of said feeding and storage means; said feeding and storage means being a premanufactured rod cage at least having a thread storage section and a thread lead-in section, said storage section comprising a plurality of rod-like, rectilinear supporting elements having support surfaces, said supporting elements having first and second ends and being disposed substantially parallel to said axis such that said support surfaces are distributed on a substantially cylindrical surface coaxial with said axis, said lead-in section being a ring, said ring comprising a plurality of holes in each of which hone of said first ends of said supporting elements is fixedly secured, and a substantially continuous, conically and inwardly tapering circumferential lead-in surface outside of said substantially cylindrical surface and coaxially disposed with respect to said axis and extending at least up to the supporting elements for leading the thread onto said storage section; and first and second means for easily mounting and dismounting said feeding and storage means as a whole to and from said rotor for cleaning, repairing and replacing the same, said first means easily and removably attaching and centering said ring on said first rotor end section, and said second means at least easily centering said second ends of said supporting elements on said second rotor end section, said second means comprising a mounting being a part of said rod cage and comprising an annular component which is placeable on the second rotor end section and which has a plurality of holes in each of which one of said second ends of said supporting elements is fixedly secured, said mounting having, on a side lying outside said support surface, a lead-out surface at least extending up to the supporting elements and widened conically outwardly, said rotor having a cavity and a first projection coaxially aligned with said axis and extending into said cavity, said mounting having a second projection extending into said cavity and being coaxially aligned with said axis, one of said projections being a tubular projection and having an inside polygonal cross-section and the other projection having an outside polygonal cross-section corresponding to the polygonal inside cross-section, said one projection being placed in said other projection for co-rotation therewith, when the rod cage is placed on the rotor.

* * * * *